United States Patent [19]

van de Plassche

[11] Patent Number: 4,816,742

[45] Date of Patent: Mar. 28, 1989

[54] STABILIZED CURRENT AND VOLTAGE REFERENCE SOURCES

[75] Inventor: Rudy J. van de Plassche, Waalre, Netherlands

[73] Assignee: North American Philips Corporation, Signetics Division, Sunnyvale, Calif.

[21] Appl. No.: 156,381

[22] Filed: Feb. 16, 1988

[51] Int. Cl.[4] ..... G05F 3/22

[52] U.S. Cl. ..... 323/314; 323/316; 323/907

[58] Field of Search ..... 323/313, 314, 315, 316, 323/907

[56] References Cited

U.S. PATENT DOCUMENTS

| | | | |
|---|---|---|---|
| 3,930,172 | 12/1975 | Dobkin | 307/297 |
| 4,460,865 | 7/1984 | Bynum et al. | 323/313 |
| 4,491,780 | 1/1985 | Neidorff | 323/313 |
| 4,682,098 | 7/1987 | Seevinck et al. | 323/315 |

OTHER PUBLICATIONS

Peter H. Saul, "An 8-bit, 5 ns Monolithic D/A Converter Subsystem", IEEE Journal of Solid-State Circuits, vol. SC-15, No. 6, Dec. '80, pp. 1033-1039.

*Primary Examiner*—Peter S. Wong

*Attorney, Agent, or Firm*—R. Meetin; D. Treacy; T. Briody

[57] ABSTRACT

Various voltage and current sources which are substantially independent of the positive supply rail are provided, some of which are also temperature independent. The basic NPN-type transistor circuit common to all provided sources generally comprises: a cross-coupled current stabilizer having first and second cross-coupled transistors where the emitter area of the first transistor is larger than the emitter area of the second transistor, a third transistor having an emitter coupled to the collector of the second cross-coupled transistor, a fourth transistor arranged as a diode and having a base coupled to the base of the third transistor and an emitter coupled to the collector of the first transistor; a first resistor coupled between the emitter of the first cross-coupled transistor and the negative rail; a second resistor coupled between the positive rail and the collector of said third transistor; a fifth transistor having its base and emitter coupled to the base and emitter of the second cross-coupled transistor to act as a current mirror thereof; and a sixth transistor coupled between the positive rail and the collector of the fifth current mirror transistor and in cascode relationship therewith. A current source is further created by coupling the base of an additional transistor to the emitter of the fifth transistor. Additional transistors and resistors are utilized in accord with various embodiments of the invention to provide multiple current sources, and voltage and current sources which are stabilized with respect to temperature.

26 Claims, 3 Drawing Sheets

STABILIZED CURRENT AND VOLTAGE REFERENCE SOURCES

BACKGROUND OF THE INVENTION

1. Field of Use

This invention broadly relates to solid state integrated current and voltage reference sources which are independent of supply line voltages. More particularly, this invention relates to a stabilized current or a stabilized voltage reference source where the provided current or voltage is both temperature compensated and independent of supply line voltage changes.

2. Background Art

In providing a current or voltage source, it is desirable that the output current or voltage vary as little as possible regardless of the change in temperature or supply voltage. It is also desirable to avoid the use of PNP transistors in the circuit as the fabrication of precision PNP transistors has proved difficult. With the foregoing in mind, various current and voltage sources have been proposed.

A prior art voltage source which is substantially temperature independent is seen in FIG. 1. The circuit of FIG. 1 basically comprises an amplifier, two transistors QA1 and QB1, and two resistors RA1 and RB1. In reviewing the operation of the circuit of FIG. 1, it is important to recall that the base-to-emitter voltage ($V_{be}$) of an NPN transistor is given approximately as:

$$V_{be}=(kT/G)\ ln(I_c/I_s) \quad (1)$$

where k is Boltzmann's constant, g is the electric charge, T is the absolute temperature (kT/g sometimes being referenced as $V_T$), $I_c$ is the collector current, and $I_s$ is the transistor saturation current which is proportional to the emitter area (or "width"). Since the amplifier of FIG. 1 causes the currents $I_{CA}$ and $I_{CB}$ to be nearly equal, upon balancing the voltages, and in accord with equation (1), $I_{CB}$ is found to be equal to $(V_T/R_B)\ln K_{BA}$ where the QB to QA emitter area ratio $K_{BA}$ has no significant dependence on $V_{CC}$, T, or processing parameters. As a result, the output voltage $V_o$ is given by:

$$V_o=R_A(I_{CA}+I_{CB})+V_{beA}\simeq 2(R_A/R_B)V_T\ln K_{BA}+V_T\ln(I_{CA}/I_{SA}) \quad (2)$$

Those skilled in the art will immediately appreciate that equation (2) is of the bandgap type with the first term having a positive, largely linear coefficient of temperature $C_T$ and the second term having a negative largely liner coefficient of temperature $C_T$ due to the strong dependence of $I_{SA}$ on T. By suitably choosing $R_A$ and $R_B$ (or the ratio thereof), $V_o$ can be made largely temperature independent. However, one disadvantage of the prior art circuit of FIG. 1 is that frequency-compensation circuitry must be used with the amplifier. Also, the use of PNP transistors is difficult to avoid if the amplifier is to operate efficiently.

Turning to FIG. 2, a current/voltage source prior art circuit is seen. Block 10 of FIG. 2 is essentially comprised of a cross coupled current stabilizer having transistors Q1, Q2, Q3, and Q4, with the collector-base junction of transistor Q1 being coupled to effectively form a diode, a resistor R1 connected between the voltage supply $V_{CC}$ and the collector of transistor Q1, and a resistor R3 coupled between ground and the emitters of transistor Q4. With the arrangement of block 10 which is described in detail in U.S. Pat. No. 3,930,172 to Dobkin, and with the balancing of the voltages, in accord with equation (1), the following is true:

$$R_3I_{C2}=V_{be2}+V_{be3}-V_{be1}-V_{be4}=V_T\ln(I_{S4}/I_{S2})+V_T\ln(I_{S1}/I_{S3}) \quad (3a)$$

With transistors Q1 and Q3 having equal emitter areas, $V_{be3}\simeq V_{be1}$ due to the fact that substantially the identical current $I_{C1}$ flows through both transistors Q1 and Q3. Hence, $$R_3I_{C2}\simeq V_T\ln(I_{S4}/I_{S2})=(kT/g)\ln K_{42} \quad (3b)$$

where the Q4-to-Q2 emitter area ratio $K_{42}$ is substantially independent of $V_{CC}$, T, and processing parameters. Neglecting the small variation of $R_3$ with T, $I_{C2}$ is proportional to T but has substantially no dependence on the high voltage supply value $V_{CC}$.

The addition of block 12 of FIG. 2 to block 10 provides a voltage reference in combination with a current source as might be suggested by Saul et al., "An 8-bit, 5 ns Monolithic D/A Converter Subsystem," *IEEE JSSC*, December 1980, pp. 1033–1039. While the provided arrangement substantially eliminates the temperature dependence of $V_o$ and uses only NPN transistors, $V_o$ is referenced to the position rail $V_{CC}$ and cannot be used in applications requiring that $V_o$ be referenced to the negative rail (often ground). A similar result (temperature compensated voltage reference circuit) is also found in U.S. Pat. No. 4,491,780 to Neidorff where the output voltage is also referenced to the positive rail.

SUMMARY OF THE INVENTION

It is therefore an object of this invention to provide current/voltage sources which are independent of the voltage of the positive supply line.

It is a further object of this invention to provide a temperature compensated voltage/multiple-current source which is referenced to the negative supply line.

It is yet another object of this invention to provide a temperature compensated voltage/multiple-current source which includes transistors of only one type and which is referenced to the negative supply line.

In accord with the objects of the invention, a voltage/current source connected between a positive and a negative voltage supply line (rail) is provided and generally comprises:

(a) a cross-coupled current stabilizer means comprising first and second cross-coupled transistors where the emitter area of the first transistor is larger than the emitter area of the second transistor, a third transistor having an emitter coupled to the collector of the second cross-coupled transistor, a fourth transistor arranged as a diode and having a base coupled to the base of the third transistor and an emitter coupled to the collector of the first transistor;

(b) a first resistor coupled between the emitter of the first cross-coupled transistor and the negative rail;

(c) a second resistor coupled between the positive rail and the collector of said third transistor;

(d) a fifth transistor having its base and emitter coupled to the base and emitter of the second cross-coupled transistor to act as a current mirror thereof; and (e) a sixth transistor coupled between the positive rail and the collector of the fifth current mirror transistor and in cascode relationship therewith, wherein the transistors are all bipolar transistors of like polarity, and the voltage at the emitter of the sixth transistor is a substantially constant output voltage which is substantially independent of the positive rail voltage.

Additional transistors and resistors are utilized in accord with various embodiments of the invention to provide a current source, a multiple current source, and voltage and current sources which are stabilized with respect to temperature. In order to create a positive supply voltage independent current source from the voltage source, an additional (seventh) transistor is provided with its base coupled to the voltage output (emitter of the sixth cascode transistor), and its emitter coupled to the negative rail. In arranging a temperature independent voltage source according to one embodiment, a third resistor is coupled between the base of the sixth cascode transistor and the collector of the fourth transistor, while a fourth resistor is coupled between the seventh transistor and the negative rail. If desired, an eighth transistor is provided with its collector coupled to the positive rail, its emitter coupled to the third resistor, and its base coupled to the collector of the third transistor.

A multiple-current source is created by the use of a plurality of transistors and resistors arranged in an identical manner to and in parallel to the seventh transistor and fourth resistor. If desired, additional transistors in cascode relationship may be added between the positive and negative rails with the base of the first cross-coupled transistor coupled to the base of one of the cascoded transistors, the base of the fourth transistor coupled to the base of the other cascoded transistor, and the coupled emitter and collector of the cascoded transistors coupled to the base of the fifth transistor. A temperature independent multiple-current source may be obtained by taking the afore-summarized basic current source, adding a diode coupled between the collector of the fourth transistor-diode and the collector of the third transistor, by adding a third resistor between the base of the sixth transistor and the negative rail, and by adding another transistor with its collector and emitter coupled about the third resistor and its base coupled to the emitter of the third transistor.

Of course, with the provided circuitry, and as will be described in detail hereinafter, the resistances and the transistor emitter areas should be carefully chosen to obtain desired results. Also, advantageously, all of the transistors are NPN-type transistors. A better understanding of the invention, and additional advantages and objects of the invention will become apparent to those skilled in the art upon reference to the detailed description and the accompanying drawings.

DETAILED DESCRIPTION OF THE PREFERRED EMBODIMENT

Figure 3A:
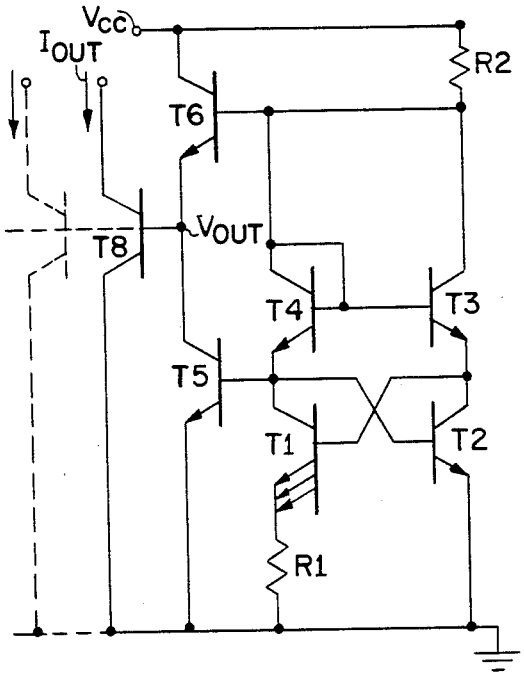
FIG. 3*a* is a circuit diagram of a positive supply voltage independent current/voltage source of the invention.
Figure 1:
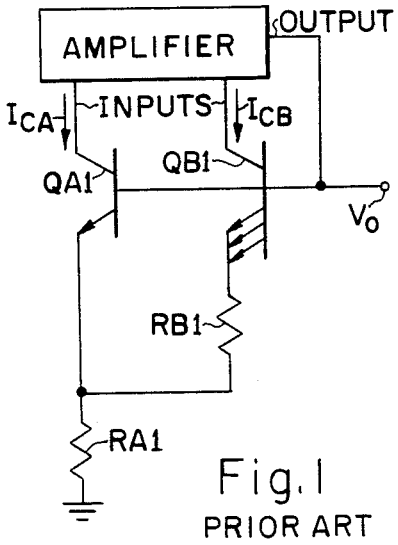
Fig.1 PRIOR ART
FIG. 1 is a circuit diagram of a substantially temperature independent voltage source of the prior art.
Figure 2:
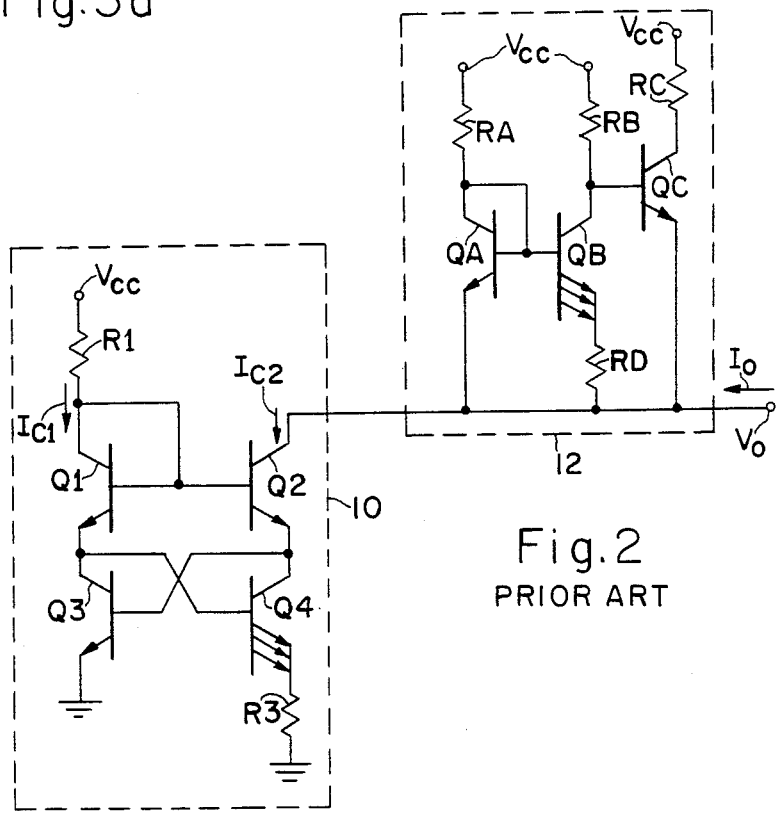
Fig.2 PRIOR ART
FIG. 2 is another circuit diagram of a current/voltage source of the prior art.

Turning to FIG. 3*a*, a circuit diagram of the preferred current/voltage source of the invention is seen. At the core of the circuit, a cross-coupled current stabilizer means is provided comprising first and second cross-coupled transistors T1 and T2, and third and fourth transistors T3 and T4. The emitter of transistor T3 is coupled to both the collector of cross-coupled transistor T2 and the base of cross-coupled transistor T1, while the emitter of cross-coupled transistor T4 is likewise coupled to both the collector of cross-coupled transistor T1 and the base of cross-coupled transistor T2. As indicated in FIG. 3a, transistors T3 and T4 are arranged with common bases, transistor T4 is arranged as a diode having its base coupled to its collector, and transistor T1 is provided with an emitter area p times larger than the emitter area of T2. The emitter of cross-coupled transistor T2 is preferably connected to the negative rail (ground), while the emitter(s) of cross-coupled transistor T1 is coupled to the negative rail through resistor R1. The collector of transistor T3 is coupled to the positive rail (Vcc) via resistor R2. The collector of transistor T4 also may be coupled to Vcc via resistor R2. It should be noted that transistors T1, T2, T3, an T4, as well as all the transistors to be recited hereinafter are preferably of the same polarity; preferably NPN-type. Also, it should be noted that all of the transistors, unless otherwise indicated, preferably have substantially identical emitter areas, i.e. emitter areas equal to the emitter area of transistor T2.

Completing the voltage source arrangement, transistors T5 and T6 are arranged in cascode relationship. Transistor T5 has an emitter coupled to the negative supply rail, a base coupled to the base of transistor T2, and a collector coupled to the emitter of transistor T6 and to the voltage output. In this arrangement, transistor T5 acts as a current mirror in conjunction with transistor T2, with the collector current of transistor T2 being the current mirror input current, and the collector current of transistor T5 being the current mirror output current. Transistor T6 has a collector coupled to the positive supply rail, and a base coupled to the collector of transistor T4.

Figure 3B:
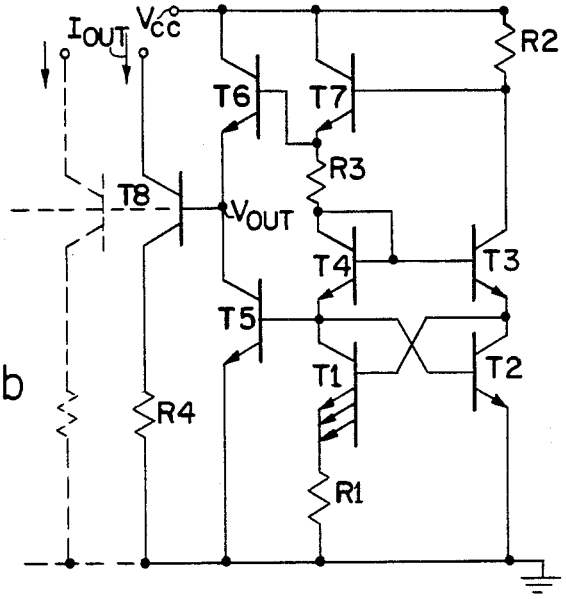
FIG. 3*b* is a circuit diagram of a preferred temperature and positive voltage supply independent voltage source and positive voltage supply independent current source of the invention.

Turning to FIG. 3*b*, the circuitry of FIG. 3*a*, including transistors T1–T6, and resistors R1 and R2 are left intact, and an additional resistor R3 and an additional transistor T7 are provided. Resistor R3 couples the collector-base of transistor T4 to the base of cascode transistor T6, while transistor T7 has its base coupled to the collector of transistor T3, its collector coupled to the positive supply rail, and its emitter coupled to the base of transistor T6. As will be discussed hereinafter, the current source circuitry includes an additional resistor (R4) beyond the transistor (T8) shown in FIG. 3*a*.

With the provided voltage source arrangements of FIGS. 3*a* and 3*b*, the following relationship is obtained:

$$V_{be4}+V_{be2}=V_{be3}+V_{be1}+I_1R1 \quad (4)$$

where $I_l$ is the current through transistor T1. Because a substantially equal current (which is approximately equal to $Vcc-\{3V_{be}/R3\}$) flows through both transistors T3 and T2 (ignoring base curents), the base-emitter voltage drop of transistors T3 and T2 are substantially equal as the emitter areas of transistors T3 and T2 are equal. Hence, relationship (4) may be simplified to $V_{be4}=V_{be1}+I_1R1$. Because substantially equal current also flows through transistors T4 and T1, in accord with equation (1):

$$V_{be4}-V_{be1}=(kT/g)ln\{I_1pi_s/I_1i_s\}=(kT/g)ln(p) \quad (5)$$

where $i_s$ is the saturation current of transistor T2. Combining simplified relationship (4) with equation (5), it is seen that:

$$I_1=(1/R1)\{(kT/g)ln(p)\} \quad (6)$$

Thus, for FIG. 3*a*, the voltage at the base of transistor T6 is determinable as $V_{be2}+V_{be4}$, while for FIG. 3*b*, the voltage at the emitter of T7 is then determinable as $V_{be2}+V_{be4}+(R2/R1)\ \{(kT/g)\ ln(p)\}$. As a result, in either case, when the supply voltage varies, the current through the transistor T2 varies and causes $v_{be2}$ to vary, which results in a variation of the voltage at the base of transistor T6. However, with the provision of transistors T5 and T6, the voltage output can be decoupled from changes in the supply voltage, and in the case of FIG. 3*b* can be made to be as substantially temperature independent.

As aforementioned, transistor T5 is arranged to provide a current mirror in conjunction with transistor T2 (i.e. the transistors are arranged in parallel). As a result, whatever current mirror input current flows through transistor T2, a substantially equal current mirror output current flows through transistor T5. Also, because transistors T5 and T6 are in cascode relationship, whatever current flow through transistor T5 is pulled from and through transistor T6. Hence, the base-emitter voltage drop across transistor T6 is substantially equal to the base-emitter voltage drop across transistor T2. With the voltage output being located at the emitter of transistor T6, for FIG. 3*a*:

$$V_{out}=V_{be2}+V_{be4}-Vbe6 \quad (7a)$$

while for FIG. 3b, $$V_{out}=V_{be2}+V_{be4}+(R3/R1)\{(kT/g)ln(p)\}-V_{be6} \quad (7b)$$

With $V_{be2}$ equal to $V_{be6}$, relationships (7a) and (7b) respectively simplify to:

$$V_{out}=V_{be4} \quad (8a)$$

$$V_{out}=V_{be4}+(R2/R1)\{(kT/g)ln(p)\} \quad (8b)$$

Relationships (8a) and (8b) are completely independent of reliance on the positive supply voltage Vcc and hence are stabilized. Moreover, with respect to FIG. 3*b* and relationship (8b), by adjusting R3 properly (given a particular R1 and emitter width ratio p), the output voltage may be arranged to be the bandgap voltage of silicon which is temperature independent.

In providing a current source for FIG. 3*a*, an additional transistor T8 is added to the provided voltage source, while in FIG. 3*b*, transistor T8 and resistor R4 are added to the provided voltage source. The base of transistor T8 is connected to the voltage source output (i.e. the emitter of transistor T6) while the emitter of transistor T8 is coupled to ground via resistor R4 (for FIG. 3*b*). The collector of transistor T8 is considered the current source output node. If a multiple current source is desired, a plurality of additional transistors or transistors and resistors arranged in the same manner as and in parallel to transistor T8 and resistor R4 can be provided. With the same emitter areas and resistances, the provided current sources will provide equal currents. Or, if desired, by arranging the emitter areas and resistances as desired, binary weighted currents, decimally weighted currents, or other desired outputs could be provided.

In both the FIG. 3*a* and FIG. 3*b* embodiments of the single current source, the emitter area of T8 is set to be equal to the emitter area of transistor T2, while in FIG. 3b, the resistance of R4 is set to the resistance of R3. Alternatively, if the width of transistor T8 is half that of T2, the resistance of resistor R4 should be twice that of resistor R3. Regardless, it will be appreciated with respect to the provided current source arrangements as opposed to the voltage source arrangements, that the added transistors T8 (and resistor R4) add additional temperature dependence. The temperature dependence can be eliminated, however, as will be discussed hereinafter with respect to FIGS. 5*a* and 5*b*.

Figure 4:
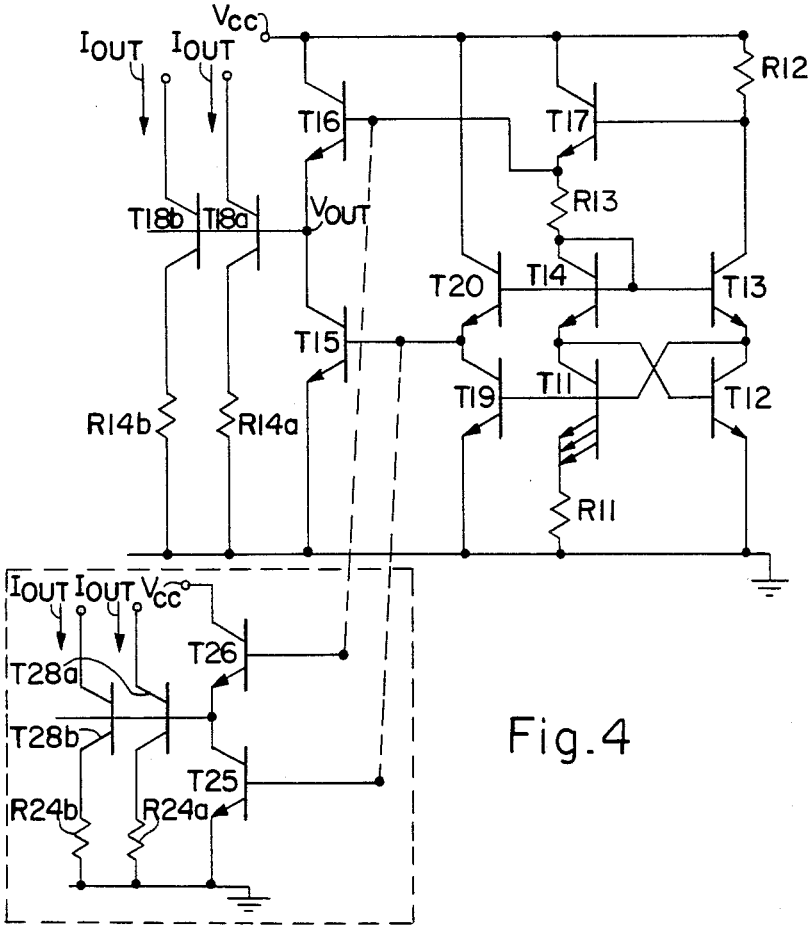
FIG. 4 is a circuit diagram of one embodiment of a positive supply voltage independent multiple current source of the invention.

Turning to FIG. 4, a multiple current source is provided which permits heavy loading of the current source by the output circuits. The core of the cross-coupled current stabilizer means comprised of transistors T11, T12, T13, and T14, with resistors R11 and R12 is identical to the arrangement of that of FIG. 3*b*. likewise, resistor R13 and transistor T17 are arranged identically to resistor R3 and transistor T7, as is transistor T16 relative to transistor T6. However, two additional transistors T19 and T20 are added to the circuit, and transistor T15 is arranged differently than transistor T5 of FIG. 3*b*. Thus, transistor T19 is connected in parallel with cross-coupled transistor T11 and resistor R11 with the base of transistor T19 being connected to the base of cross-coupled transistor T11, and the emitter of transistor T19 being coupled to ground. The collector of transistor T19 is coupled to the base of transistor T15 (which is otherwise arranged as transistor T5 of FIG. 3*b*), as well as to the emitter of cascode transistor T20. The base of transistor T20 is coupled to the base of transistor T14, and the collector of transistor T20 is coupled to the positive voltage rail Vcc. Loading the voltage output $V_{out}$ are a plurality of transistors with resistors coupling their emitters to the negative rail. As seen in FIG. 4, a first set of transistors T18*a* and T18*b* with resistors R14*a* and R14*b* are shown as providing current outputs from the voltage output obtained at the junction of transistors T15 and T16. However, if desired, and as shown in phantom, one or more additional blocks of multiple current source output circuitry can be provided such as by providing transistors T25 and T26 in parallel with transistors T15 and T16 and by providing transistors T28*a*, T28*b* . . . and resistors R24*a*, R24*b* . . . therewith.

With the provided arrangement of FIG. 4, the base to emitter voltage of transistor T15 is determined as:

$$V_{be15}=V_{be12}+V_{be14}-V_{be20} \quad (9)$$

Because transistor T11 has a large emitter area and a resistor R11 attached to its emitter, and because transistor T19 has its base coupled to the base of transistor T11, the current through transistors T19 and T11 can be arranged to be equal. Hence, the current through transistor T20 can be equal to the current through transistor T14. With the emitter areas of transistors T14 and T20 being equal, the base emitter voltage drops across the two transistors are substantially equal, and relationship (9) reduces to $V_{be15}=V_{be12}$. As a result, the current through transistor T15 varies in the same manner as the input current through transistor T12. With transistors T15 and T16 in cascode relationship, the current through transistor T16 likewise varies in the same manner as the current through transistor T12. Hence, the output voltage $V_{out}$ is equal to $V_{be14}+(R13/R11)\{(kT/g)\ln(p)\}$, and represents the same stabilized voltage which is seen at the voltage output in FIG. 3b. Again, the output currents flowing through the various output transistors and resistors can be controlled as desired, but are still somewhat temperature dependent.

The multiple current source arrangement of FIG. 4 permits heavier loading on the output as transistors T19 and T20 decouple the loading of the multiple current sources from the stabilized cross-coupled circuit T11, T12, T13, T14. Transistor T17 operates as a current gain stage and supplies current to the base of the multiple output current sources (T16, T26 . . .) and resistor R13. In this way, the operation of the basic stabilizer is not influenced by the output loading.

Figure 5B:
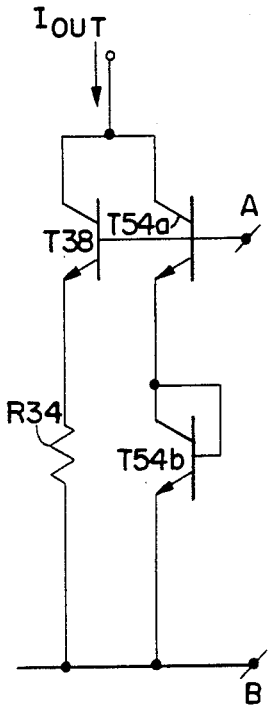
FIG. 5*b* is a circuit diagram of an alternative embodiment of the output circuitry of the preferred temperature independent current source of the invention.
Figure 5A:
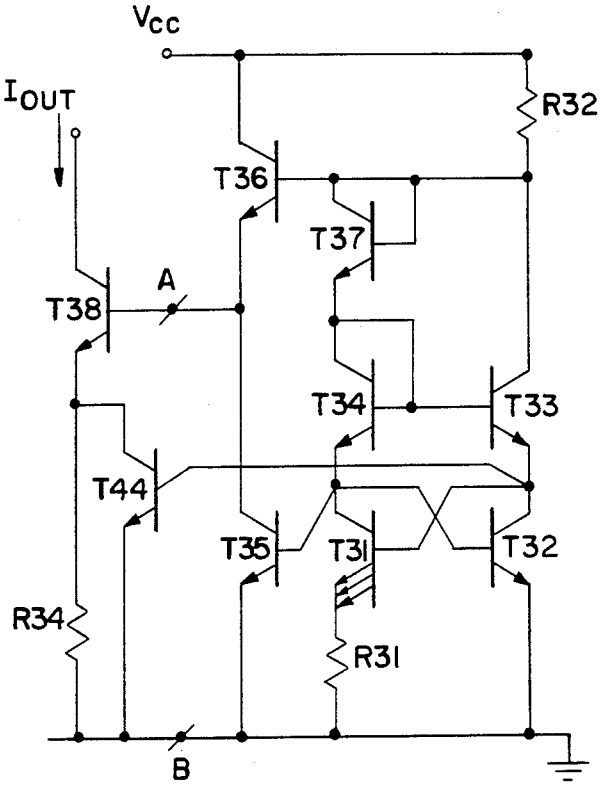
FIG. 5*a* is a circuit diagram of a preferred temperature independent current source of the invention.

Turning to FIG. 5*a*, a temperature-independent, positive rail-independent current source is seen. Again, the core cross-coupled current stabilizer circuit including cross-coupled transistors T31 and T32, and transistors T33 and T34 are provided with resistor R31 coupling the emitter of transistor T31 to ground. Also, as with FIGS. 3*b* and 4, a resistor R32 is provided which couples the collector of transistor T33 with the positive rail, and cascoded transistors T35 and T36 are arranged with transistor T35 mirroring the current through transistor T32, and the voltage output being at the emitter of transistor T36. However, instead of using a resistor such as R3 or R13, and a transistor such as T7 and T17, a transistor-diode T37 is provided with its emitter coupled to the collector-base of transistor T34, and its collector-base coupled to the base of transistor T36 as well as to resistor R32. Also, preferably an additional transistor T44 is provided with its collector coupled to a node between the output transistor T38 and its associated emitter resistor R34, its base coupled to the collector of transistor T32, and its emitter coupled to the negative rail.

With the provided arrangement of FIG. 5a, a voltage variation in the positive rail will cause a variation in current through transistor T32 which is mirrored by transistor T35 and hence by transistor T36 which is in cascode relationship with transistor T35. As a result, the output voltage at the emitter of transistor T36 is equal to $2V_{be34}$(i.e. $V_{be32}+V_{be34}+V_{be37}-V_{be36}$) when $V_{be34}=V_{be37}$. The $2V_{be34}$ voltage is applied to the base of transistor T38 having degeneration resistor R34 coupling its emitter to the negative rail. Without transistor T44 connected, a voltage drop equal to approximately $V_{be34}$ is generated across degeneration resistor R34 thereby giving the current through R34 a negative temperature coefficient. With transistor T44 connected, the base-emitter voltage of transistor T44 must be equal to the voltage drops across the base-emitter junction of transistor T31 and resistor R31. Hence, the collector current of transistor T44 is substantially equal to the collector currents of transistors T31 and T34 which have a positive temperature coefficient. Adding the currents through transistor T44 and the current through resistor R34 together results in an output current with an adjustable temperature coefficient. In order to create an output current which is substantially independent of temperature, the value of resistor R34 can be chosen to be approximately equal to the bandgap voltage of silicon divided by the output current ($V_{gap}/I_{out}$). By adjusting R31 properly, a desired output current is obtained.

FIG. 5*b* shows an alternative manner of arranging the output circuitry of FIG. 5*a* to create a temperature-independent current source. Thus, instead of providing transistor T44 in the previously discussed manner, two transistors T54*a* and T54*b* are provided in cascode relationship. Transistor T54*a* has its base coupled to the emitter of transistor T36 as well as to the base of transistor T38, its collector coupled to the collector of transistor T38 (i.e. to the current source output), and its emitter coupled to the collector-base of transistor T54*b*. The emitter of transistor T54*b* is coupled to the negative rail. In a similar manner to the output arrangement of FIG. 5*a*, the temperature coefficient of the current flowing through transistors T54*a* and T54*b* may be balanced with the temperature coefficient of the current flowing through transistor T38 and resistor R34 to provide the substantially temperature independent current source.

With respect to both FIGS. 5*a* and 5*b*, a multiple current source which is independent of temperature may be obtained. In FIG. 5*a*, a plurality of transistors can be connected with their bases coupled to the base of transistor T38 and their emitters coupled to resistors which are coupled to the negative rail. Likewise, a plurality of transistors such as transistor T44 can be coupled to the base of transistors T31 and T44 with their collectors coupled to the emitters of their respectively associated output transistors and their emitters coupled to the negative rail. The current outputs can be made temperature independent by carefully choosing the values of their respective degeneration resistors. Of course, resistor R31 must likewise be chosen carefully.

In a similar manner to the creation of multiple current sources from the output circuitry of FIG. 5*a*, multiple current sources can be created with the output circuitry of FIG. 5*b*. For each desired current source three additional transistors and one degeneration resistor are used and arranged in a similar manner to transistors T54*a*, T54*b*, and T38, and resistor R34 of FIG. 5*b*. Thus, two additional transistors having coupled bases and coupled collectors would have their bases coupled to the base of transistor T38 (their collectors not being coupled to the collector thereof). An additional transistor arranged as a diode would couple the emitter of one transistor to the negative rail, while the degeneration resistor would couple the emitter of the other transistor to the negative rail.

There has been described and illustrated herein a plurality of voltage and current sources all of which are independent of the positive rail voltage. While particular embodiments of the invention have been described, it is not intended that the invention be limited thereby, as it is intended that the invention be broad in scope and that the specifications be read likewise. For example, while a single transistor was shown as providing the critical current mirror (which permits independence from the positive rail) for one of the cross-coupled transistors of the standard cross-coupled stabilizer, it will be recognized that current mirrors having different numbers of transistors are known and could be utilized. Further, as the current flowing through transistor T3 (T13, or T33) is substantially identical to the current flowing through transistor T2 (T12, or T32), transistor T5 (T15, or T35) could be arranged to mirror the current flowing through T3 rather than through T2. Indeed, it should be recognized that the terminology "current mirror" is to read broadly, such that for purposes herein, any circuitry which will permit a current to flow at one location which is equivalent to the current flowing at another location may be considered a current mirror. Thus, the embodiment of FIG. 4 includes a current mirror (roughly, transistor T12 in conjunction with transistors T20, T19, and T15, with transistor T19 being especially arranged relative to transistor T11 and resistor R11). Further, while the provided circuits required certain balancing of resistor values, it will be recognized that the described balancing was general in nature. In fact, slightly different balancing might be advantageous when accounting for base currents which were not made a part of the provided analysis for the sake of simplicity. Therefore, it will be apparent to those skilled in the art that yet other changes and modifications may be made to the invention as described without departing from the spirit and scope of the invention as so claimed.

I claim:

1. A voltage source connected between a positive and a negative voltage supply rail, comprising:

(a) a cross-coupled current stabilizer means comprising first and second bipolar cross-coupled transistors each having an emitter, where the emitter area of said first transistor is larger than the emitter area of said second transistor, a third bipolar transistor having an emitter coupled to a collector of said second cross-coupled transistor, a fourth bipolar transistor arranged as a diode and having a base coupled to a base of said third transistor and an emitter coupled to a collector of said first transistor;

(b) a first resistor coupled between said emitter of said first cross-coupled transistor and said negative rail;

(c) a second resistor coupled between said positive rail and a collector of said third transistor;

(d) a fifth bipolar transistor having a collector coupled to said positive rail; and (e) a current mirror means for mirroring the current flowing through said second cross-coupled transistor, an emitter of said fifth transistor being coupled to an output of said current mirror means, wherein the voltage at the emitter of said fifth transistor is a substantially constant voltage which is substantially independent of the voltage of said positive rail, and said bipolar transistors are all of like polarity.

2. A voltage source according to claim 1, wherein:

said current mirror means comprises a sixth bipolar transistor in conjunction with said second cross-coupled transistor, said sixth transistor having a base coupled to a base of said second cross-coupled transistor, an emitter coupled to an emitter of said second cross-coupled transistor, and a collector coupled to said emitter of said fifth transistor, wherein said collector of said second cross-coupled transistor is an input of said current mirror.

3. A voltage source according to claim 1, further comprising:

(f) a third resistor coupling said base and collector of said fourth transistor to a base of said fifth bipolar transistor.

4. A voltage source according to claim 3, wherein:

said first and third resistors are chosen to have resistances having a particular ratio, and said first and second transistors are chosen with emitters having a particular emitter area ratio, such that given the temperature dependence of the base to emitter voltage of said fourth transistor, that said output voltage is further maintained substantially independent of temperature.

5. A voltage source according to claim 4, further comprising:

(g) a sixth bipolar transistor of like polarity having an emitter coupled to a base of said fifth transistor, a base coupled to said collector of said third transistor, and a collector coupled to said positive rail.

6. A voltage source according to claim 5, wherein:

said current mirror means comprises a seventh bipolar transistor of like polarity in conjunction with said second cross-coupled transistor, said seventh transistor having a base coupled to a base of said second cross-coupled transistor, an emitter coupled to an emitter of said second cross-coupled transistor, and a collector coupled to the emitter of said fifth transistor.

7. A voltage source according to claim 4, wherein:

said third, fourth, and fifth transistors have emitter areas substantially equal to the emitter of said second transistor.

8. A current source connected between a positive and a negative voltage supply rail, comprising:

(a) a cross-coupled current stabilizer means comprising first and second cross-coupled bipolar transistors each having an emitter, where the emitter area of said first transistor is larger than the emitter area of said second transistor, a third bipolar transistor having an emitter coupled to a collector of said second cross-coupled transistor, a fourth transistor arranged as a diode and having a base coupled to a base of said third transistor and an emitter coupled to a collector of said first transistor;

(b) a first resistor coupled between said emitter of said first cross-coupled transistor and said negative rail;

(c) a second resistor coupled between said positive rail and a collector of said third transistor;

(d) a fifth bipolar transistor having a collector coupled to said positive rail; and an emitter coupled to said input to said current mirror means;

(e) a current mirror means for mirroring the current flowing through said second cross-coupled transistor, said collector of said second cross-coupled transistor being an input of said current mirror means, and an emitter of said fifth transistor being coupled to an output of said current mirror means; and (f) at least one sixth bipolar output transistor, each sixth output transistor having a base coupled to said emitter of said fifth transistor, and each sixth output transistor having a collector with a node coupled thereto acting as a current source, wherein said bipolar transistors are all of like polarity.

9. A current source according to claim 8, further comprising:

(g) a third resistor coupling a base of said fifth transistor to said collector-base of said fourth transistor; and (h) at least one fourth resistor, each fourth resistor coupling an emitter of one sixth output transistor to said negative rail.

10. A current source according to claim 9, wherein:

said at least one sixth output transistor comprises a plurality of sixth output transistors and said at least one fourth resistor comprises a plurality of fourth resistors, and said current source is a multiple current source substantially independent of the voltage of said positive rail.

11. A current source according to claim 10, wherein:

said sixth output transistors and said fourth resistors are chosen for each transistor-resistor couple such that an index of the emitter area of said sixth output transistor multiplied by the resistance of said fourth resistor provides a substantially identical value for each said couple to provide substantially equal current outputs.

12. A current source according to claim 10, wherein:

said sixth output transistors and said fourth resistors are chosen for each transistor-resistor couple such that an index of the emitter area of said sixth output transistor multiplied by the resistance of said fourth resistor provides a value which is a binary power of another transistor-resistor couple to provide substantially binary weighted current outputs.

13. A current source according to claim 9, further comprising:

(i) a seventh bipolar transistor of like polarity having an emitter coupled to a base of said fifth transistor, a base coupled to said collector of said third transistor, and a collector coupled to said positive rail.

14. A current source according to claim 13, wherein:

said current mirror means comprises an eighth bipolar transistor of like polarity in conjunction with said second transistor, said eighth transistor having a base coupled to a base of said second cross-coupled transistor, an emitter coupled to an emitter of said second cross-coupled transistor, and a collector coupled to the emitter of said fifth transistor.

15. A current source according to claim 9, wherein:

said current mirror means comprises a seventh bipolar transistor of like polarity in conjunction with said second transistor, said seventh transistor having a base coupled to a base of said second cross-coupled transistor, an emitter coupled to an emitter of said second cross-coupled transistor, and a collector coupled to the emitter of said fifth transistor.

16. A current source according to claim 9, wherein:

said current mirror means comprises a seventh bipolar transistor of like polarity in conjunction with said third transistor, said seventh transistor having a base coupled to a base of said third transistor, and a collector coupled to the emitter of said fifth transistor.

17. A current source according to claim 9, wherein:

said current mirror means comprises, in conjunction with said second transistor, a seventh bipolar transistor of like polarity having an emitter coupled to said negative rail and a collector coupled to said emitter of said fifth transistor, an eighth bipolar transistor of like polarity having a base coupled to a base of said fourth transistor, a collector coupled to said positive rail and an emitter coupled to a base of said seventh transistor, and a ninth bipolar transistor of like polarity having a collector coupled to said base of said seventh transistor, a base coupled to said base of said first cross-coupled transistor, and an emitter coupled to said negative rail, wherein the resistance of said first resistor and the emitter areas of said first cross-coupled transistor and said ninth transistor are chosen such that whatever the current that flows through said first transistor, a substantially equal current flows through said ninth transistor.

18. A current source according to claim 17, further comprising:

a tenth bipolar transistor of like polarity having a base coupled to the collector of said third transistor, a collector coupled to said positive rail, and an emitter coupled to a base of said fifth transistor, wherein said at least one sixth output transistor comprises a plurality of sixth output transistors and said at least one fourth resistor comprises a plurality of fourth resistors, and said current source is a multiple current source substantially independent of the voltage of said positive rail.

19. A current source according to claim 18, further comprising:

one or more stages coupled to said emitter of said tenth transistor and said emitter of said eighth transistor, each stage comprising a plurality of transistors and at least one resistor arranged in a manner identical to an arrangement of said fifth transistor, said seventh transistor, said at least one sixth transistor, and said at least one fourth resistor.

20. A current source according to claim 18, wherein:

said sixth output transistors and said fourth resistors are chosen for each transistor-resistor couple such that an index of the emitter area of said sixth output transistor multiplied by the resistance of said fourth resistor provides a substantially identical value for each said couple to provide substantially equal current outputs.

21. A current source according to claim 18, wherein:

said sixth output transistors and said fourth resistors are chosen for each transistor-resistor couple such that an index of the emitter area of said sixth output transistor multiplied by the resistance of said fourth resistor provides a value which is a binary power of another transistor-resistor couple to provide substantially binary weighted current outputs.

22. A current source according to claim 8, further comprising:

(g) a seventh bipolar transistor of like polarity having a base and a collector coupled to said base and collector of said fourth transistor;

(h) at least one eighth bipolar transistor of like polarity for each sixth transistor, each eighth transistor having a base coupled to said collector of said first cross-coupled transistor, a collector coupled to said emitter of its corresponding sixth output transistor, and an emitter coupled to said negative rail; and (i) at least one third resistor for each sixth transistor, each third resistor coupling an emitter of a corresponding sixth transistor to said negative rail.

23. A current source according to claim 22, wherein:

said at least one third resistor is chosen to have a resistance substantially equal to the bandgap voltage of silicon divided by an output current flowing to a collector of a respective sixth transistor, such that said current source is substantially independent of temperature and substantially independent of said voltage of said positive rail.

24. A current source according to claim 23, wherein: said current mirror means comprises a ninth bipolar transistor of like polarity in conjunction with said second cross-coupled transistor, said ninth transistor having a base coupled to a base of said second cross-coupled transistor, an emitter coupled to an emitter of said second cross-coupled transistor, and a collector coupled to the emitter of said fifth transistor.

25. A current source according to claim 8, further comprising:

(g) a seventh bipolar transistor of like polarity having a base and a collector coupled to said base and collector of said fourth transistor;

(h) at least one eighth bipolar transistor of like polarity for each sixth transistor, each eighth transistor having a base coupled to said collector of said first cross-coupled transistor, a collector coupled to said emitter of its corresponding sixth output transister, and an emitter coupled to said negative rail;

(i) at least one third resistor for each sixth transistor, each third resistor coupling an emitter of a corresponding sixth transistor to said negative rail; and (j) at least one ninth bipolar transistor of like polarity for each of said sixth transistors, said ninth transistor having a base and a collector coupled to an emitter of said eighth transistor, and an emitter coupled to said negative rail.

26. A current source according to claim 25, wherein: said current mirror means comprises a tenth bipolar transistor of like polarity in conjunction with said second cross-coupled transistor, said tenth transistor having a base coupled to a base of said second cross-coupled transistor, an emitter coupled to an emitter of said second cross-coupled transistor, and a collector coupled to the emitter of said fifth transistor.

* * * * *